United States Patent [19]

Kawanabe et al.

[11] Patent Number: 4,715,350

[45] Date of Patent: Dec. 29, 1987

[54] AIR INTAKE SIDE SECONDARY AIR SUPPLY SYSTEM FOR AN INTERNAL COMBUSTION ENGINE WITH A DUTY RATIO CONTROL OPERATION

[75] Inventors: Tomohiko Kawanabe, Utsunomiya; Noritaka Kushida, Tokyo; Masahiko Asakura, Tokorozawa; Yasunari Seki, Utsunomiya, all of Japan

[73] Assignee: Honda Giken Kogyo Kabushiki Kaisha, Tokyo, Japan

[21] Appl. No.: 818,637

[22] Filed: Jan. 14, 1986

[30] Foreign Application Priority Data

Feb. 16, 1985 [JP] Japan ..... 60-28759

[51] Int. Cl.[4] ..... F02M 23/04

[52] U.S. Cl. ..... 123/587; 123/589

[58] Field of Search ..... 123/587, 589, 438, 440, 123/339

[56] References Cited

U.S. PATENT DOCUMENTS 4,364,227 12/1982 Yoshida et al. ..... 123/589
4,434,768 3/1984 Ninomiya ..... 123/589
4,558,677 12/1985 Hara ..... 123/440
4,561,394 12/1985 Kishida et al. ..... 123/587
4,584,979 4/1986 Fujimura et al. ..... 123/589

*Primary Examiner*—William A. Cuchlinski, Jr.
*Attorney, Agent, or Firm*—Pollock, VandeSande & Priddy

[57] ABSTRACT

An air intake side secondary air supply system for an internal combustion engine having an air intake system using a carburetor and an air intake side secondary air supply passage leading to the downstream of the carburetor, includes an oxygen concentration sensor producing an output signal whose level is substantially proportional to an oxygen concentration of the exhaust gas. A control means for controlling a duty ratio of opening and closing of an open/close valve disposed in the air intake side secondary air supply passage in accordance with a result of comparison between the level of the output signal of the oxygen concentration sensor and a level corresponding to a target air-fuel ratio. The target air-fuel ratio is up-dated in response to at least two parameters indicative of the engine operation.

3 Claims, 7 Drawing Figures

AIR INTAKE SIDE SECONDARY AIR SUPPLY SYSTEM FOR AN INTERNAL COMBUSTION ENGINE WITH A DUTY RATIO CONTROL OPERATION

BACKGROUND OF THE INVENTION

1. Field of the Invention

The present invention relates to an air intake side secondary air supply system for an internal combustion engine, and more particularly to a system which performs a duty ratio control of an open/close valve disposed in an air intake side secondary air supply passage.

2. Description of Background Information

Air-fuel ratio feedback control systems for an internal combustion engine are well known as systems in which oxygen concentration in the exhaust gas of the engine is detected by an oxygen concentration sensor (referred to as $O_2$ sensor hereinafter) and the air-fuel ratio of the mixture to be supplied to the engine is feedback controlled in response to an output signal level of the $O_2$ sensor for the purification of the exhaust gas and an improvement of the fuel economy. As an example of the air-fuel ratio feedback control system, an air-intake side secondary air supply system for the feedback control is proposed, for example, in Japanese Patent Publication No. 55-3533. In this air intake side secondary air supply system, an open/close valve is disposed in an air intake side secondary air supply passage which communicates with the carburetor on the downstream side of the throttle valve, and the open/close valve is on-off controlled in response to the output signal level of the $O_2$ sensor, so as to effect a "duty ratio control" of the supply of the air intake side secondary air. In conventional air intake side secondary air supply systems as the above, it is general to set an open/close duty ratio of the open/close valve only in response to a result of a comparison between the output signal level of the $O_2$ sensor and a level corresponding to a target air-fuel ratio. For this reason, a delay of the response of the feedback control tends to become large especially when the engine operation enters into a low load condition. This delay of response corresponds to the time required for the detection of the supply of the air intake side secondary air by means of the $O_2$ sensor in the form of a change in the oxygen concentration in the exhaust gas. As a result, it is difficult to avoid a hunting of the air-fuel ratio from the target air-fuel ratio, which in turn has been causing a deterioration of the driveability of the engine and an increase of noxious components in the exhaust gas.

OBJECT AND SUMMARY OF THE INVENTION

An object of the present invention is to provide an air intake side secondary air supply system for an internal combustion engine, in which the hunting of the air-fuel ratio is prevented, to improve the driveability of the engine and to reduce the amount of the noxious component in the exhaust gas.

According to the present invention, an air intake side secondary air supply system includes an oxygen sensor for producing an output signal having a level proportional to the oxygen concentration in the exhaust gas. The system determines a target air-fuel ratio in accordance with at least two engine parameters, and effects a duty ratio control of the opening and closing of an open/close valve disposed in the air intake side secondary air supply passage in accordance with a result of a comparison between an output signal level of the oxygen sensor and a level corresponding to the target air-fuel ratio.

DETAILED DESCRIPTION OF THE INVENTION

Referring to FIGS. 1 through 7 of the accompanying drawings, the embodiment of the air intake side secondary air supply system according to the present invention will be explained hereinafter.

Figure 1:
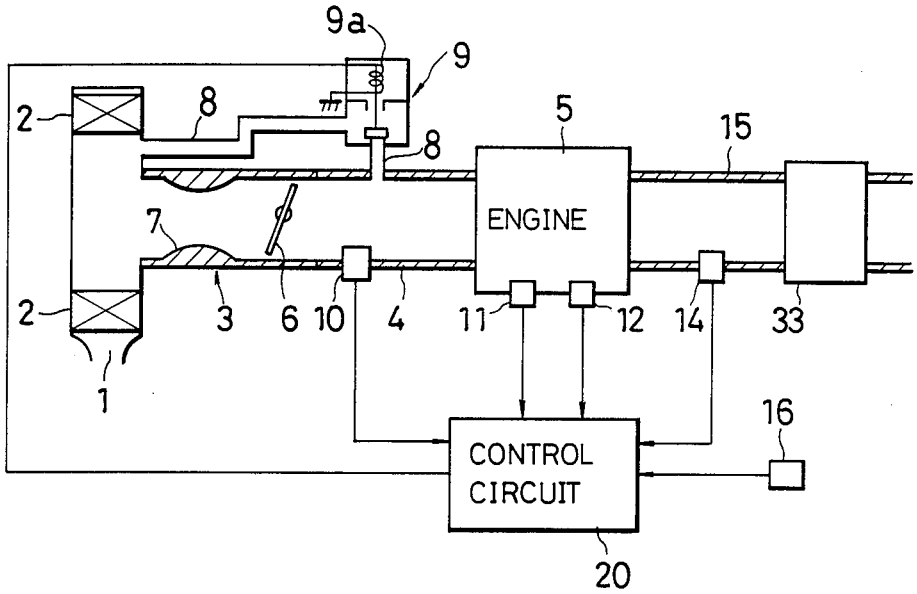
FIG. 1 is a schematic diagram showing a general construction of the system according to the invention.

In FIG. 1, which illustrates the embodiment of the air intake side secondary air supply system, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid **9*a*** thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean oxygen concentration sensor 14 which is provided in an exhaust manifold 15 of the engine for generating an output signal whose level varies in proportion to an oxygen concentration in the exhaust gas.

Figure 2:
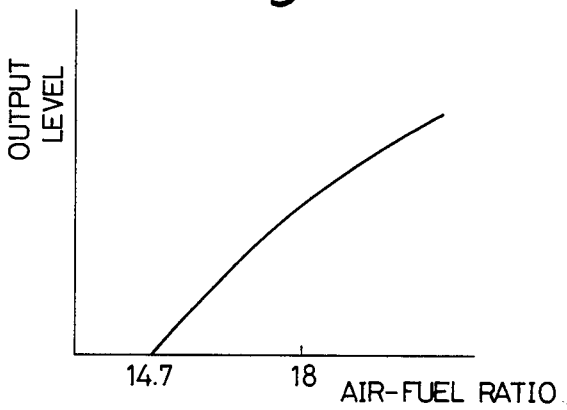
FIG. 2 is a diagram showing a signal output characteristic of the oxygen concentration sensor 14 used in the system of FIG. 1.

FIG. 2 shows a signal output characteristic of the oxygen concentration sensor 14. As shown, the output signal level of the oxygen concentration sensor increases proportionally as the oxygen concentration in the exhaust gas becomes leaner from a stoichiometric air-fuel ratio value. Further, a catalytic converter 33 for accelerating the reduction of the noxious components in the exhaust gas is provided in the exhaust manifold 15 at a location on the downstream side of the position of the oxygen concentration sensor 14. The open/close solenoid valve 9, the absolute pressure sensor 10, the crank angle sensor 11, the engine cooling water temperature sensor 12, and the oxygen concentration sensor 14 are electrically connected to a control circuit 20. Further, a vehicle speed sensor 16 for producing an output signal whose level is proportional to the speed of the vehicle is electrically connected to the control circuit 20.

Figure 3:
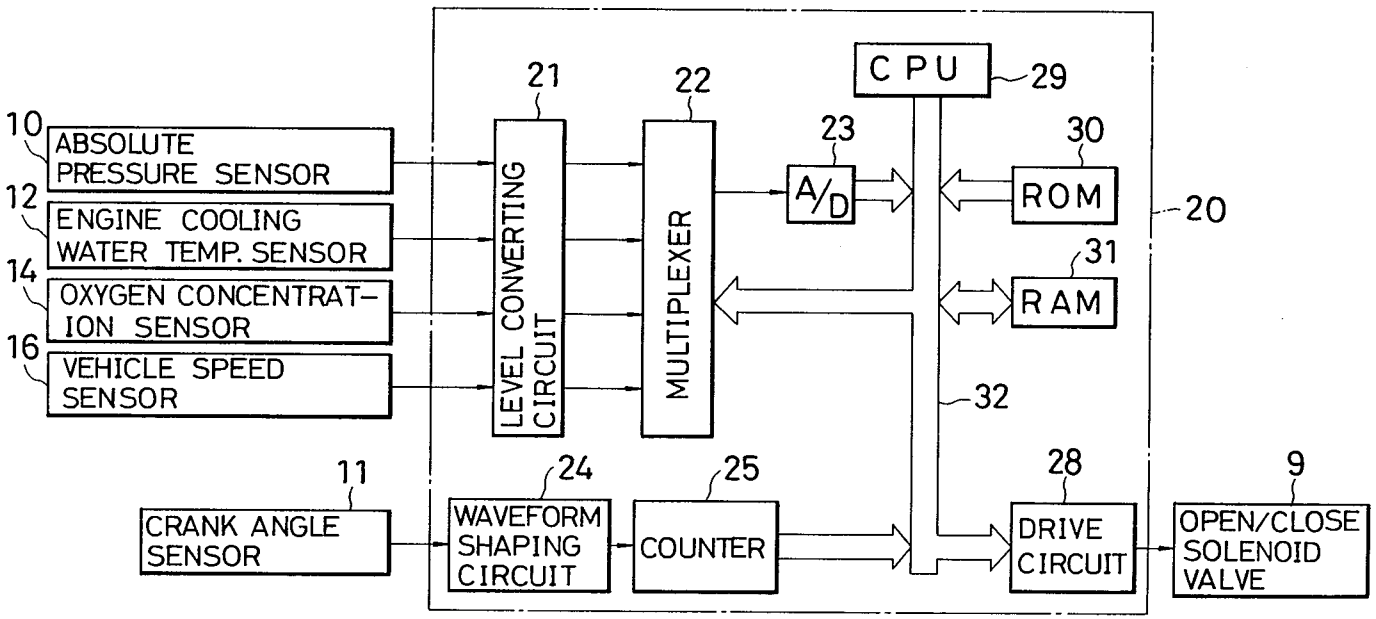
FIG. 3 is a block diagram showing the construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the oxygen concentration sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus-constructed control circuit 20, information about the absolute pressure in the intake manifold 4, the engine cooling water temperature, the oxygen concentration in the exhaust gas, and the vehicle speed, and information indicative of the engine speed are selectively supplied from the A/D converter 23 and the counter 25, respectively, to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 4:
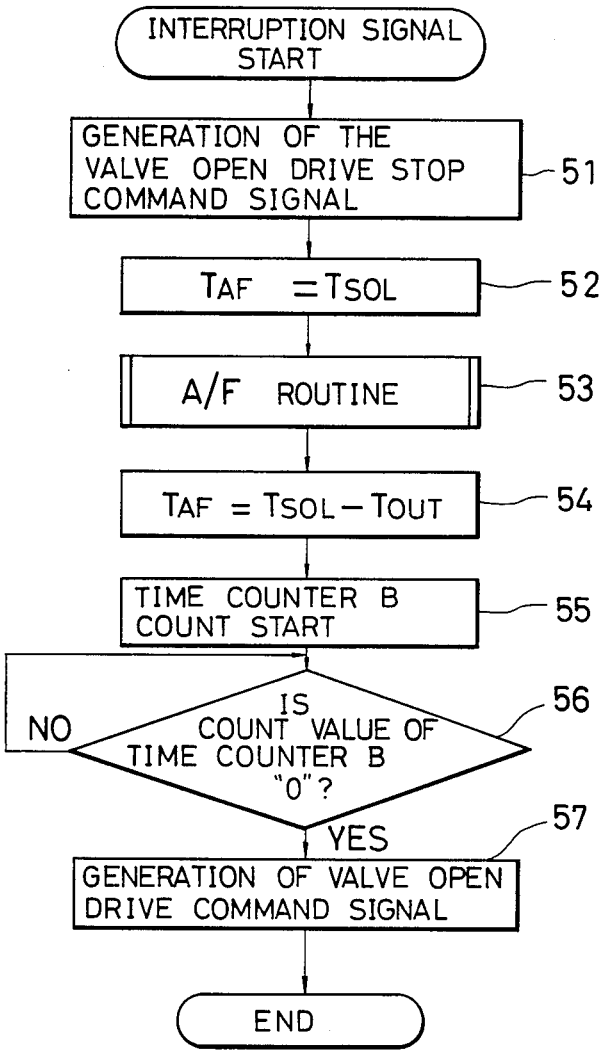
FIGS. 4 and 5 are flowcharts showing the manner of operation of a CPU 29 in the control circuit 20.
Figure 5:
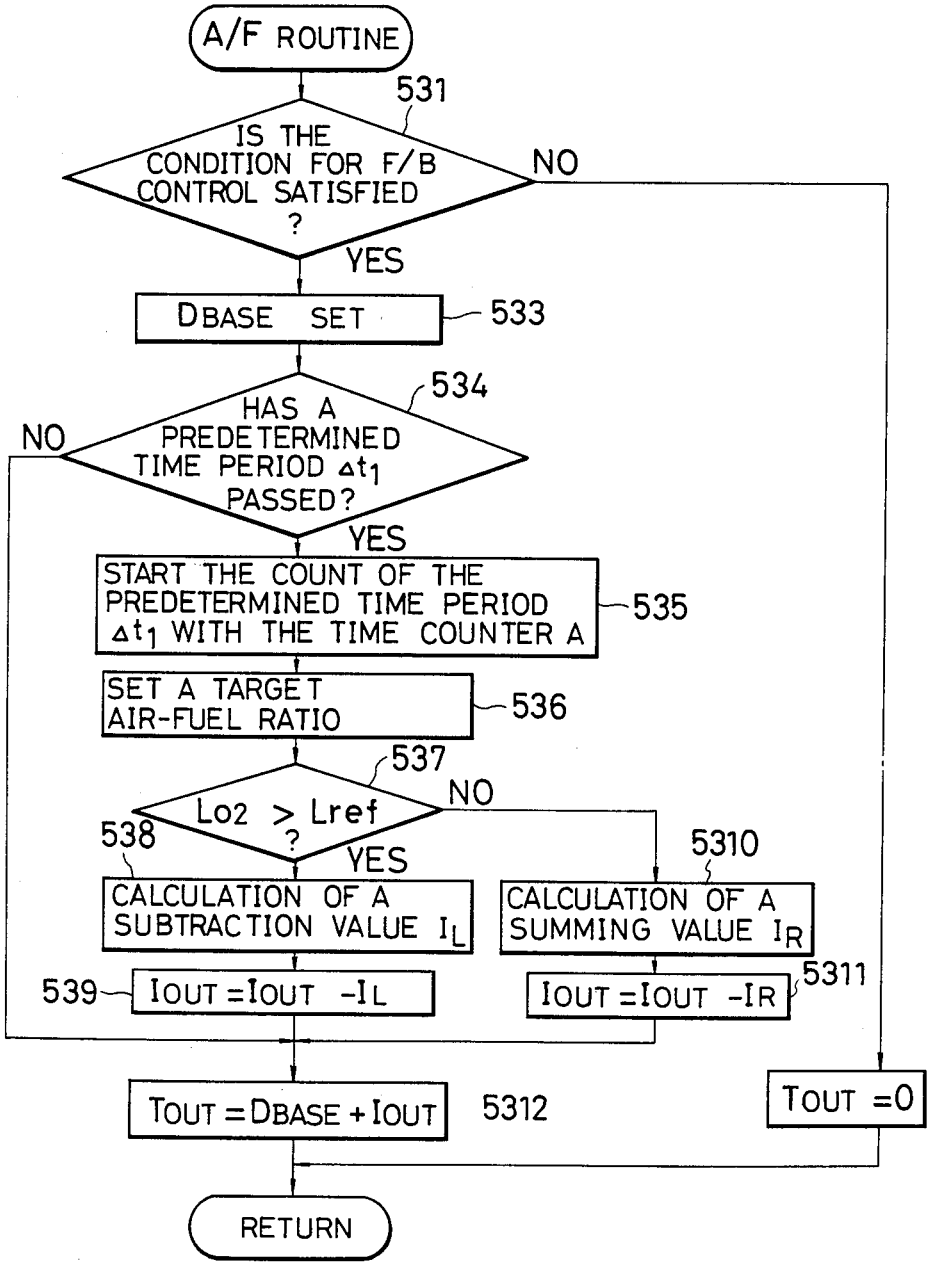

Referring to the flowcharts of FIGS. 4 and 5, the operation of the air intake side secondary air supply system according to the present invention will be explained hereinafter.

At a step 51, a valve open drive stop command signal is generated in the CPU 29 and supplied to the drive circuit 28, each time an internal interruption signal in the CPU 29 occurs. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at step 52, and an A/F routine for calculating a valve open period $T_{OUT}$ of the open/close solenoid valve 9 which is shown in FIG. 5 is carried out through steps generally indicated at 53.

Figure 6:
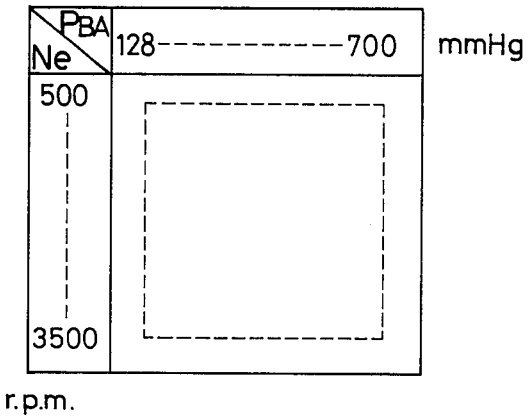
FIG. 6 is a diagram showing a data map which is stored in a ROM 30 of the control circuit 20.

In the A/F routine, whether or not operating states of the vehicle (including operating states of the engine) satisfy a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9, is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 6, and the CPU 29 firstly reads-in current values of the absolute pressure $P_{BA}$ and the engine speed $N_e$ and in turn searches a value of the period of base duty ratio $D_{BASE}$ corresponding to the read-in values from the $D_{BASE}$ data map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from the time of the supply of the air intake side secondary air to the time in which a result of the supply of the air intake side secondary air is detected by the oxygen concentration sensor as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the initial value by the time counter A, i.e. the execution of the step 535, is performed at the step 534. After the start of the counting of the predetermined time period $\Delta t_1$ by the time counter A in this way, a target air-fuel ratio which is leaner than the stoichiometric air-fuel ratio is set at a step 536. For the setting of the target air-fuel ratio, various values for a reference level Lref corresponding to the target air-fuel ratio which is determined according to the values of the absolute pressure within the intake manifold $P_{BA}$ and the engine speed $N_e$, as in the case of the $D_{BASE}$ data map, are previously stored in the ROM 30 as an A/F data map. Therefore, the CPU 29 searches a reference level Lref corresponding to the current values of the absolute pressure $P_{BA}$ and the engine speed $N_e$ from the A/F data map. Next, from the information of the oxygen concentration, whether or not the output signal level $LO_2$ of the oxygen concentration sensor 14 is greater than the reference level Lref determined at the step 536 is detected at a step 537. In other words, whether or not an air-fuel ratio of the mixture to be supplied to the engine 5 is leaner than the target air-fuel ratio is detected at the step 537. If $LO_2 > Lref$, it means that the air-fuel ratio of the mixture is leaner than the target air-fuel ratio, and a subtraction value $I_L$ is calculated at a step 538. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of the operation of the A/F routine is read out from a memory location a1 in the RAM 31. Subsequently, the subtraction value $I_L$ is subtracted from the correction value $I_{OUT}$, and a result is in turn written in the memory location a1 of the RAM 31 as a new correction value $I_{OUT}$, at a step 539. On the other hand, if $LO_2 \leqq Lref$ at the step 537, it means that the current air-fuel ratio of the mixture is richer than the target air-fuel ratio, and a summing value $I_R$ is calculated at a step 5310. The summing value $I_R$ is calculated by a multiplication among a constant value $K_2$ ($\neq K_1$), the engine speed $N_e$, and the absolute pressure $P_{BA}$ ($K_2 \cdot N_e \cdot P_{BA}$), and is dependent on the amount of the intake air of the engine 5. After the calculation of the summing value $I_R$, the correction value $I_{OUT}$ which is previously calculated by the execution of the A/F routine is read out from the memory location a1 of the RAM 31; and the summing value $I_R$ is added to the read out correction value $I_{OUT}$. A result of the summation is in turn stored in the memory location a1 of the RAM 31 as a new correction value $I_{OUT}$ at a step 5311. After the calculation of the correction value $I_{OUT}$ at the step 539 or the step 5311 in this way, the correction value $I_{OUT}$ and the period of basic duty ratio $D_{BASE}$ set at the step 533 are added together, and the result is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$, at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 7:
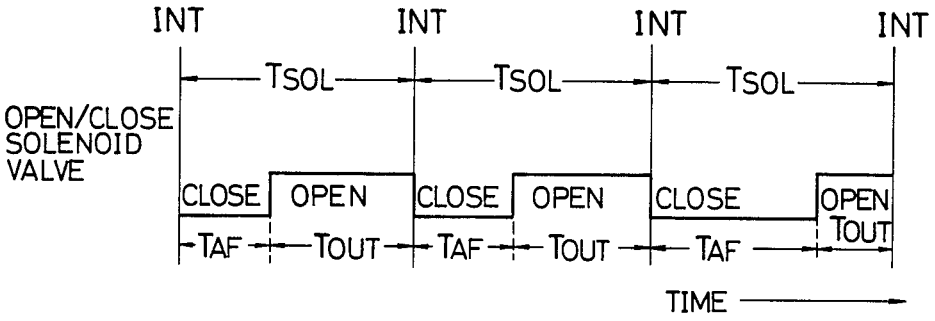
FIG. 7 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 7, to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations.

It will be appreciated from the foregoing that, according to the present invention, the fuel consumption characteristic of the engine can be improved by setting the target value of the air-fuel ratio control on the leaner side of the stoichiometric air-fuel ratio. This is enabled by the employment of the oxygen concentration sensor 14 having such an output signal characteristic as shown in FIG. 2.

In the above explained embodiment, the engine speed value and the value of absolute pressure within the intake manifold are used as at least two engine parameters. However, it is to be noted that the engine parameters are not limited to this, and for instance, the amount of the intake air and the engine speed can be used as the parameters of the engine operation.

Thus, in the air intake side secondary air supply system according to the present invention, an oxygen concentration sensor generating an output signal whose output signal level is proportional to the oxygen concentration of the exhaust gas is utilized; and a target value of the air-fuel ratio control is determined responsive to at least two parameters of the engine operation. Further, the duty ratio of the opening and closing of an open/close valve disposed in an air intake side secondary air supply passage is controlled according to a result of comparison between the output signal level of the oxygen concentration sensor and a level corresponding to the target air-fuel ratio. With this feature, the air-fuel ratio of the mixture supplied to the engine is always controlled to a desired value by the feedback operation in response to the state of the engine operation. In this way, the delay of response of the feedback control which has been recognized in conventional arrangements is greatly reduced and the hunting of the air-fuel ratio relative to the target air-fuel ratio is prevented. Thus, an improvement of the driveability of the engine and a reduction of the amount of the noxious components in the exhaust gas are realized.

What is claimed is:

1. An air intake side secondary air supply system for an internal combustion engine having an air intake passage with a carburetor and an exhaust passage, comprising:

an air intake side secondary air supply passage communicating with the air intake passage on the downstream side of the carburetor;

an open/close valve disposed in said air intake side secondary air supply passage;

an oxygen concentration sensor disposed in the exhaust passage and producing an output signal whose level is substantially proportional to an oxygen concentration of the exhaust gas;

means for setting a target air-fuel ratio in response to at least two parameters representing engine operation; and comparing means for comparing the output signal of said oxygen concentration sensor and a level corresponding to said target air-fuel ratio;

control means for continuously controlling an opening ratio of said open/close valve, said control means calculating said opening ratio in response to a result of comparison between the output signal of the oxygen concentration sensor and said level corresponding to said target air-fuel ratio and supplying an opening ratio control signal at predetermined intervals, so that said open/close valve is opened or closed in response to said ratio control signal which is supplied at said predetermined intervals.

2. An air intake side secondary air supply system as set forth in claim 1, in which the level of said output signal of oxygen concentration sensor becomes substantially proportional to the oxygen concentration of the exhaust gas when an air-fuel ratio of mixture supplied to the engine is on a lean side with respect to the stoichiometric air-fuel ratio.

3. An air intake side secondary air supply system as set forth in claim 1, wherein said at least two parameters are an absolute pressure within an intake manifold of the engine and an engine rotational speed, and wherein said means for setting a target air-fuel ratio comprises means for detecting the absolute pressure within the intake manifold, means for detecting the engine rotational speed, and means for memorizing various values of the target air-fuel ratio with respect to given values of the absolute pressure and the engine rotational speed in the form of a data map, and means for reading from said memorizing means a value of the target air-fuel ratio according to currently detected values of the absolute pressure and the engine rotational speed.

* * * * *